US007237416B2

(12) United States Patent
Toeniskoetter

(10) Patent No.: US 7,237,416 B2
(45) Date of Patent: Jul. 3, 2007

(54) ROBOTIC TURNTABLE DRIVE ARRANGEMENT IN A ROBOTIC ROLLER HEMMING SYSTEM

(75) Inventor: James B. Toeniskoetter, Rochester Hills, MI (US)

(73) Assignee: Hirotec America, Inc., Auburn Hills, MI (US)

( * ) Notice: Subject to any disclaimer, the term of this patent is extended or adjusted under 35 U.S.C. 154(b) by 134 days.

(21) Appl. No.: 11/010,620

(22) Filed: Dec. 13, 2004

(65) Prior Publication Data

US 2006/0123868 A1 Jun. 15, 2006

(51) Int. Cl.
*B21D 7/02* (2006.01)
*B21D 43/00* (2006.01)

(52) U.S. Cl. ..... 72/214; 72/220; 72/306; 72/421

(58) Field of Classification Search ..... 72/220, 72/214, 420, 421, 426, 387, 306; 29/243.58, 29/243.57

See application file for complete search history.

(56) References Cited

U.S. PATENT DOCUMENTS

| | | | | |
|---|---|---|---|---|
| 4,996,866 | A * | 3/1991 | Masera et al. | 72/387 |
| 6,477,879 | B1 * | 11/2002 | Sawa | 72/220 |
| 7,134,309 | B2 * | 11/2006 | Toeniskoetter | 72/306 |
| 2006/0123615 | A1 * | 6/2006 | Toeniskoetter | 29/429 |

* cited by examiner

*Primary Examiner*—Dmitry Suhol
(74) *Attorney, Agent, or Firm*—Fildes & Outland, P.C.

(57) ABSTRACT

A robotic turntable drive arrangement in a robotic roller hemming system includes a turntable having a top plate and a lower frame. The top plate is rotatable about the lower frame. The turntable further includes a plurality of lock positions. The arrangement also includes a robot having an arm adapted for engagement with the turntable top plate. Movement of the robot arm while the robot arm is engaged with the turntable top plate rotates the turntable top plate.

11 Claims, 5 Drawing Sheets

ROBOTIC TURNTABLE DRIVE ARRANGEMENT IN A ROBOTIC ROLLER HEMMING SYSTEM

TECHNICAL FIELD

This invention relates to robotic roller hemming, and more particularly to fixture positioning and orientation to locate a part to be hemmed in a robotic roller hemming system.

BACKGROUND OF THE INVENTION

It is known in the art relating to robotic roller hemming to utilize a motorized turntable to rotate a fixture to position a part to be hemmed thereon in front of a robotic roller hemmer. The fixture is driven into required orientations to allow for complete hemming of the perimeter of a workpiece, for example a closure panel, being hemmed. The use of a motorized turntable undesirably increases the cost of such roller hemming arrangements. For simpler workpiece/closure piece configurations, the turntable may be eliminated and replaced with a fixed unit. A fixed unit, however, severely limits reach and access to the fixture. Also, a fixed unit is only usable with a minimum number of fixture configurations.

SUMMARY OF THE INVENTION

The present invention provides a robotic turntable drive arrangement in a robotic roller hemming system. The robotic turntable drive allows for the reach and access of a motorized turntable system without the additional cost of an independent drive system. Further, the present invention is usable for hemming a variety of part configurations. The present invention may also be especially useful in low volume hemming systems in which cost is a more important consideration than process cycle time.

More particularly, a robotic turntable drive arrangement in a robotic roller hemming system in accordance with the present invention includes a turntable that is rotatable by the hemming robot to index the turntable between multiple fixed points around the robot. The turntable includes a lower frame and a top plate connected to the lower frame by a bearing. A locking device, such as a single stop lock actuator or similar, accurately locates one of a plurality of lock positions of the turntable and locks the top plate into the lock position after the robot has moved the turntable into the lock position. The robot moves the turntable by first engaging the top plate with an end of an arm of the robot, for example a hemming roller end effector. The robot then releases the lock, rotates the turntable to a different position, and reengages the lock.

In a specific embodiment, a robotic turntable drive system includes a robot having a base and a swingable, movable arm. The robot has a first axis of rotation extending through the base. The turntable drive further includes a turntable including a lower frame, a top plate, and a rotatable bearing connecting the lower frame to the top plate. The top plate is rotatable on the frame via the bearing. The turntable further is adapted to be locked into a plurality of lock positions disposed around the bearing. The robot arm is engagable with the turntable top plate. The turntable drive may also include a locking device for locking the turntable at one of the lock positions. The turntable top plate is rotatable by the robot arm via the bearing when the locking device is unlocked, and locking the locking device temporarily fixes the turntable at one of the lock positions.

The turntable top plate may include a plurality of engagement members spacedly disposed along an outer edge of the top plate. The robot may include a roller end effector engagable with the turntable top plate at the engagement members.

In an alternative embodiment, the turntable may include a rotatable bearing having a round gear. The round gear has a multiplicity of teeth defining lock positions around the round gear. The locking device is engagable with the teeth of the round gear for locking the turntable in the lock positions.

A method of driving a turntable for a robotic roller hemmer system includes the step of providing a robotic turntable drive arrangement in a robotic roller hemming system as described above. The method may further include the steps of: rotating the robot arm about the robot first axis to align the robot arm with a portion of the turntable; engaging the robot arm with the turntable top plate; unlocking the locking device; rotating the turntable top plate from one lock position to another of the lock positions; locking the locking device; and releasing the robot arm from the turntable top plate.

Alternatively, the step of providing a robotic turntable drive arrangement may include providing a turntable top plate including a plurality of engagement members spacedly disposed along an outer edge of the top plate and the step of engaging the robot arm with the turntable top plate may include engaging the robot arm with one of the engagement members of the top plate.

These and other features and advantages of the invention will be more fully understood from the following detailed description of the invention taken together with the accompanying drawings.

DETAILED DESCRIPTION OF THE INVENTION

Figure 2:
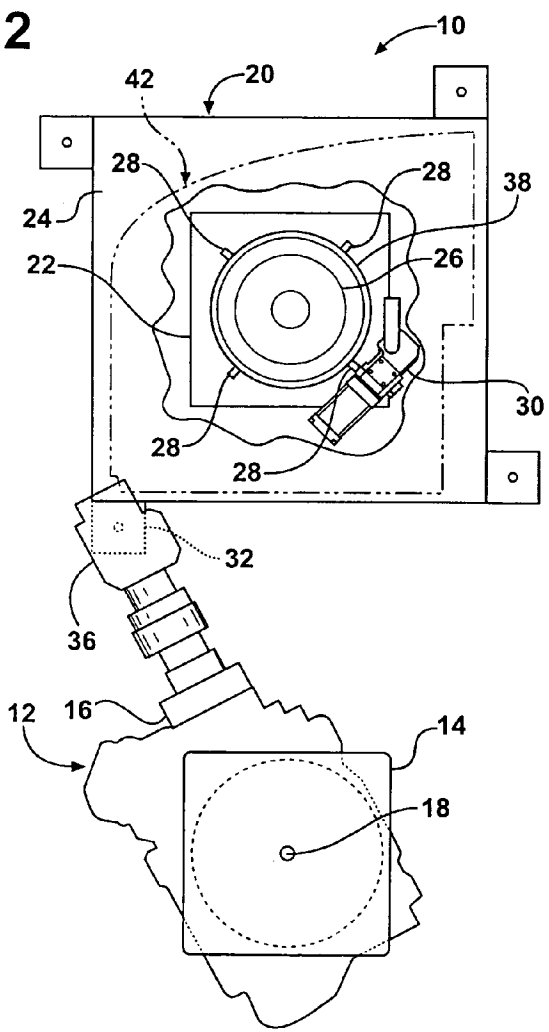
FIG. 2 is a plan view of the robotic turntable drive arrangement of FIG. 1 illustrating the robotic arm engaging an engagement member of a turntable of the turntable drive arrangement.

Referring now to the drawings in detail, numeral 10 generally indicates a robotic turntable drive arrangement in a robotic roller hemming system in accordance with the present invention. The robotic turntable drive arrangement allows for turntable rotation and positioning without the additional cost of an independent drive system. The robotic turntable drive arrangement also allows for hemming a variety of part configurations.

Figure 1:
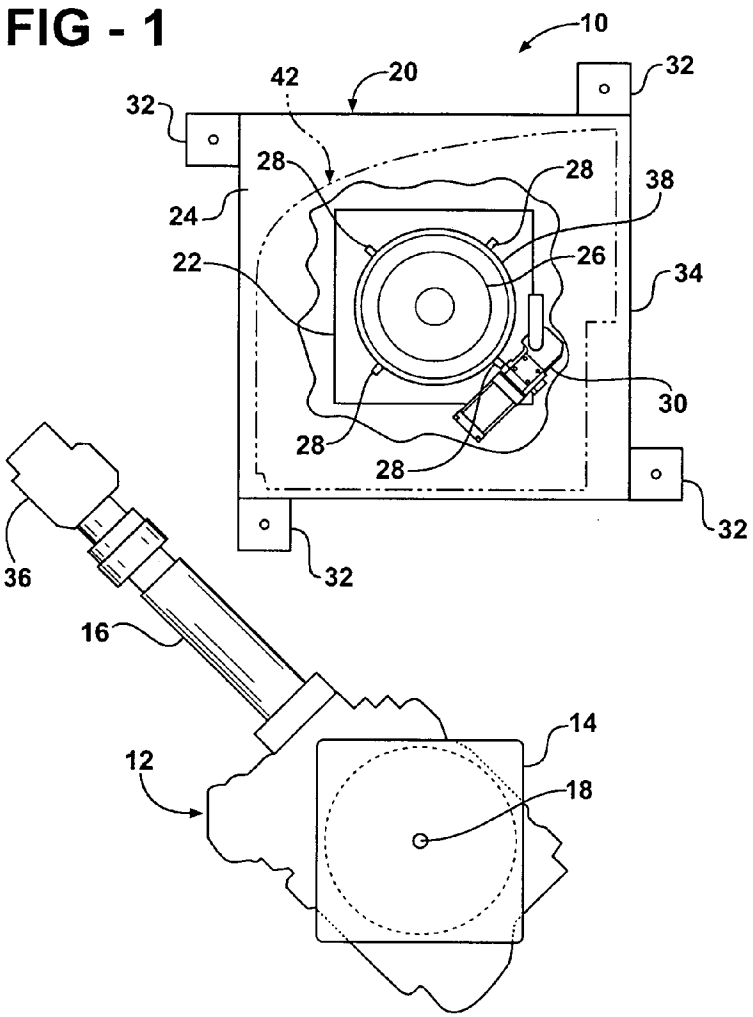
FIG. 1 is a plan view of a robotic turntable drive arrangement in accordance with the present invention illustrating a robotic arm of a robot in a resting position.
Figure 4:
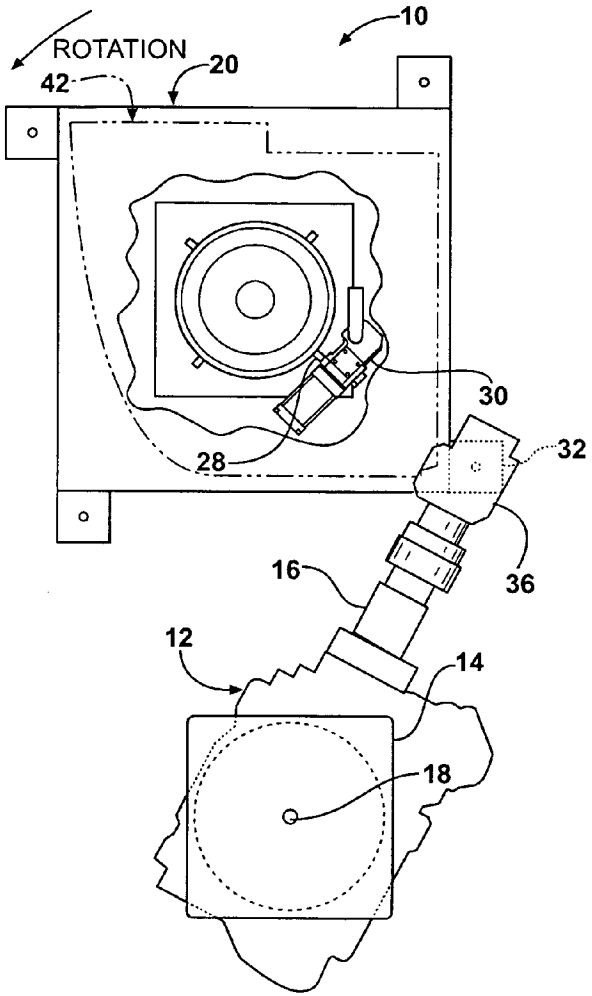
FIG. 4 is a plan view of the robotic turntable drive arrangement of FIG. 1 illustrating the robot having rotated the turntable to a new position.
Figure 3:
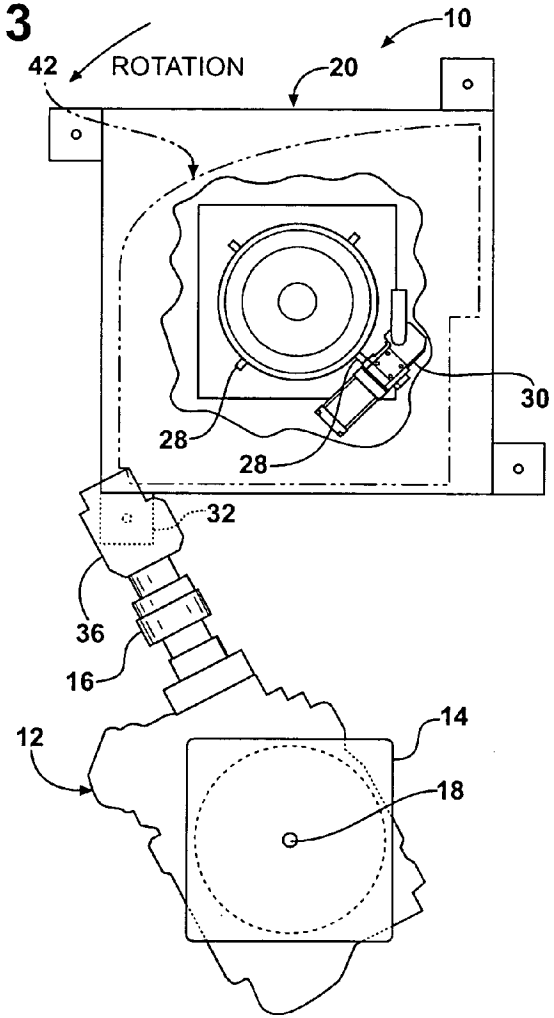
FIG. 3 is a plan view of the robotic turntable drive arrangement of FIG. 1 illustrating the robot beginning to rotate clockwise about its first axis, thereby causing counterclockwise rotation of the turntable.
Figure 6:
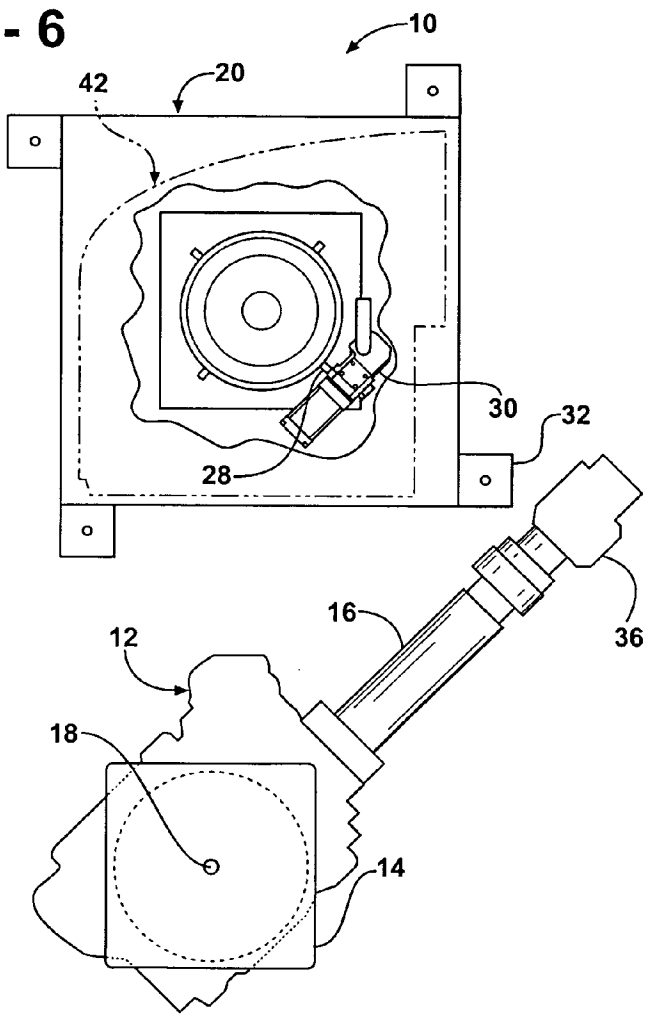
FIG. 6 is a plan view of the robotic turntable drive arrangement of FIG. 1 illustrating the robotic arm of the robot returned to a resting position.
Figure 5:
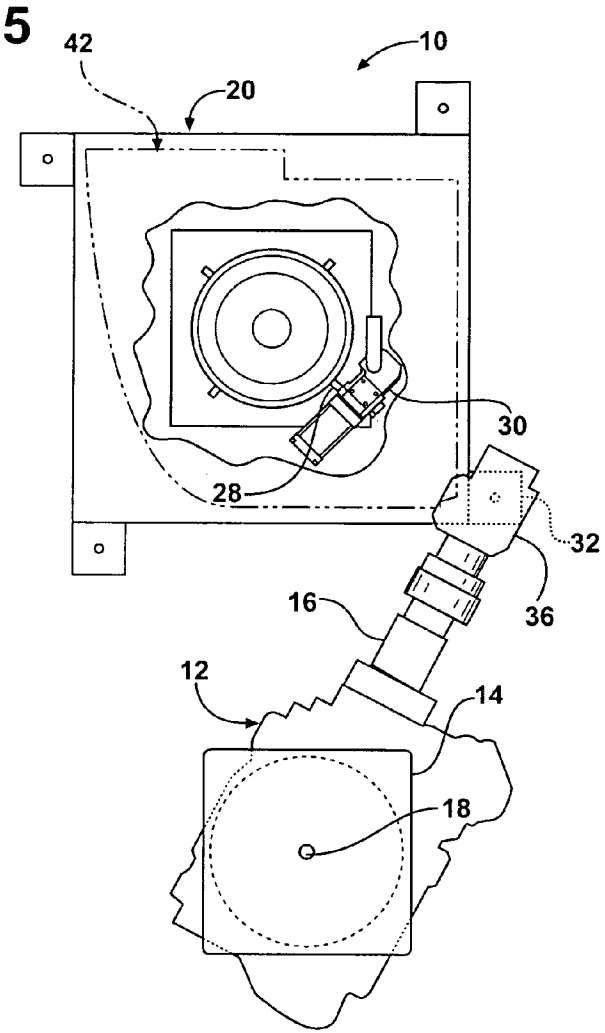
FIG. 5 is a plan view of the robotic turntable drive arrangement of FIG. 1 illustrating the robot disengaging the engagement member of the turntable of the turntable drive.
Figure 7:
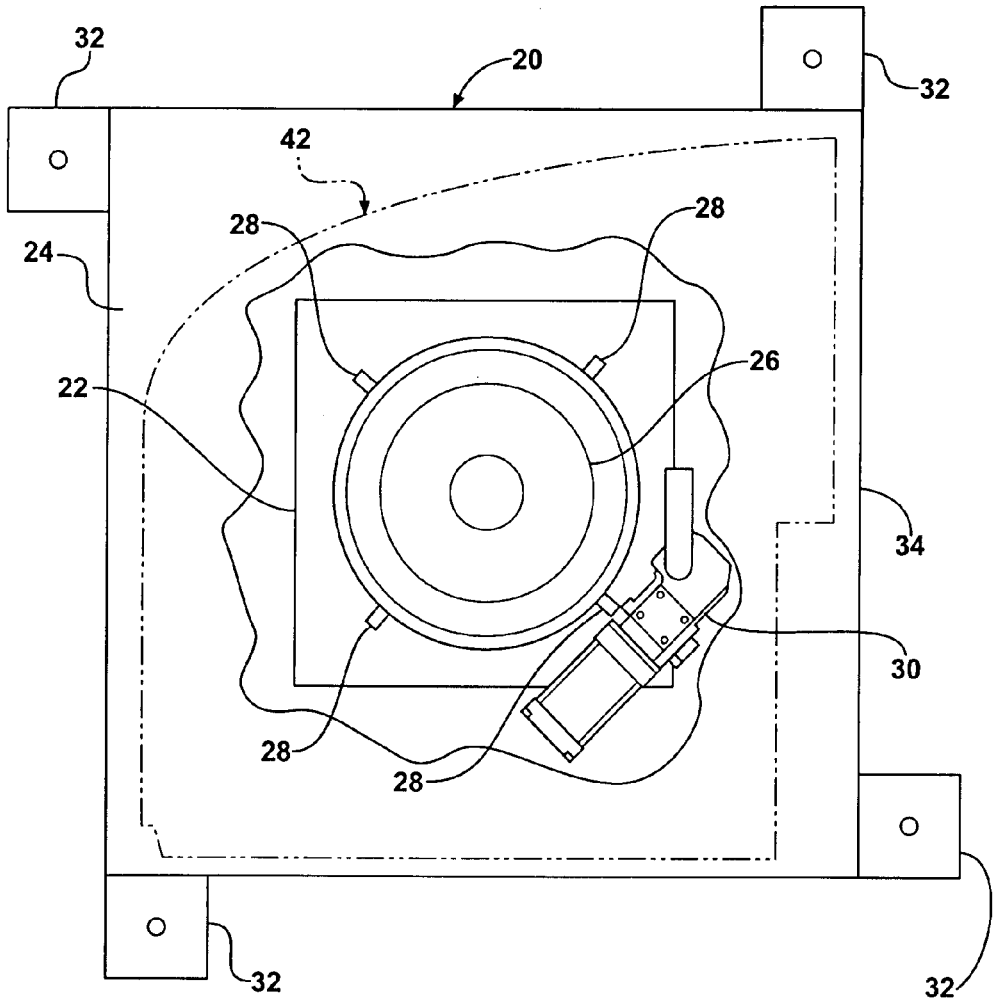
FIG. 7 is a plan view of a turntable of the robotic turntable drive arrangement of FIG. 1.

As shown in FIGS. 1 and 7, the robotic turntable drive arrangement 10 includes a robot 12 including a base 14 and a swingable, movable arm 16. The robot 12 has a first axis of rotation 18 extending through the base 14. The turntable drive system 10 further includes a turntable 20 including a lower frame 22, a top plate 24, and a rotatable bearing 26 connecting the lower frame to the top plate. The top plate 24 is rotatable on the frame 22 via the bearing 26. The turntable 20 further includes a plurality of lock positions 28 disposed around the bearing. The robot arm 16 is engagable with the turntable top plate 24. The turntable drive 10 may also include a locking device 30 for locking the turntable 20 at one of the lock positions 28. The turntable top plate 24 is rotatable by the robot arm 16 via the bearing 26 when the locking device 30 is unlocked, and locking the locking device temporarily fixes the turntable 20 at one of the lock positions 28.

The turntable top plate 24 may include a plurality of engagement members 32 spacedly disposed along an outer edge 34 of the top plate. The robot 12 may include a roller end effector 36 engagable with the turntable top plate 24 at the engagement members 32.

Figure 8:
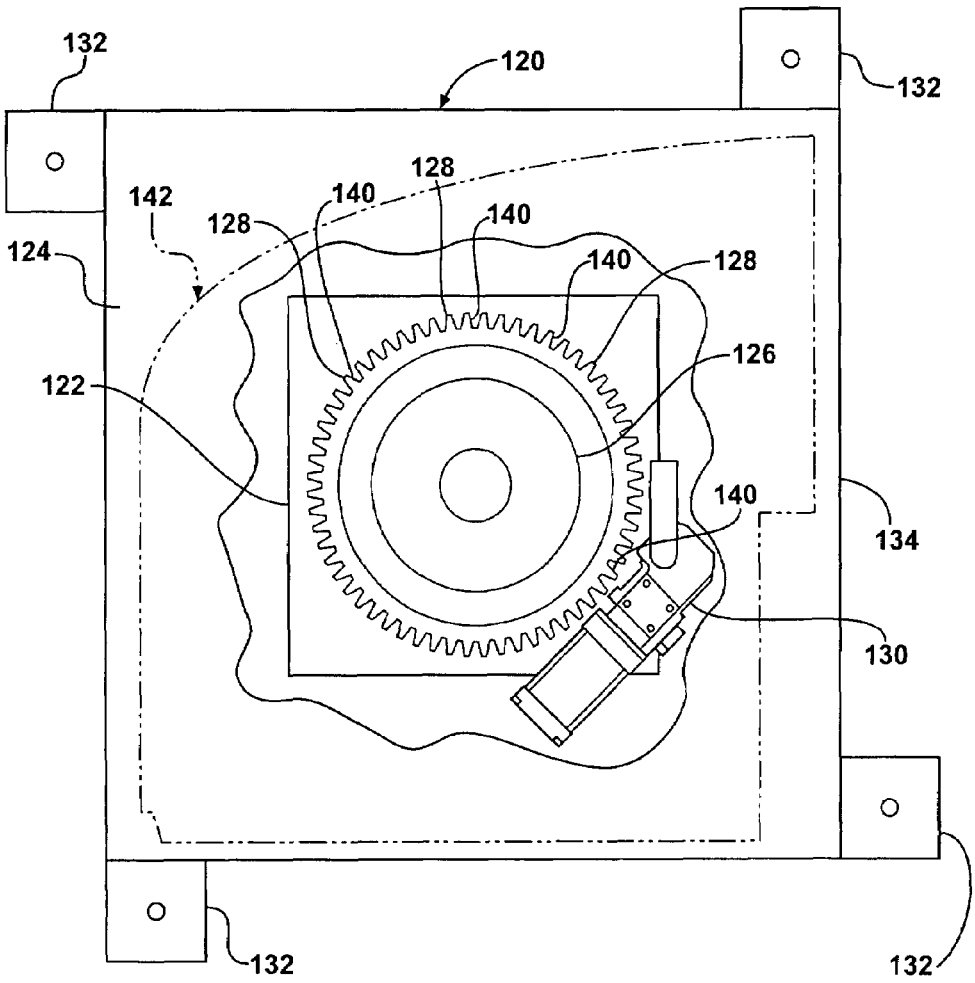
FIG. 8 is a plan view of an alternative embodiment of the turntable of the robotic turntable drive arrangement of FIG. 1.

In an alternative embodiment shown in FIG. 8, the turntable 120 may include a rotatable bearing 126 having a round gear 138. The round gear 138 has a multiplicity of teeth 140 defining lock positions 128 around the round gear. The locking device 130 is engagable with the teeth 140 of the round gear 138 for locking the turntable 120 at lock positions 128.

With reference now to FIGS. 1 through 6, a method of driving a turntable 20 for a robotic roller hemmer system includes the step of providing a robotic turntable drive arrangement in a robotic roller hemming system 10 as described above. The robot arm 16 is then rotated about the robot first axis 18 to align the robot arm 16 with a portion of the turntable 20. The robot arm 16 is then engaged with the turntable top plate 24. The locking device 30 is unlocked and the turntable top plate 24 is rotated from one lock position 28 to another of the lock positions 28. After rotating the turntable top plate 24, the locking device 30 is locked and the robot arm 16 is released from the turntable top plate 24.

Alternatively, the step of providing a robotic turntable drive arrangement 10 may include providing a turntable top plate including a plurality of engagement members 32 spacedly disposed along an outer edge 34 of the top plate 24 and the step of engaging the robot arm 16 with the turntable top plate 24 may include engaging the robot arm 16 with one of the engagement members 32 of the top plate 24.

The robotic turntable drive arrangement 10 is adapted to position (rotate) a turntable and a part 42 disposed thereon in the orientations required to allow for complete hemming of the perimeter of the part 42 by the robot 12. The part 42 may be placed on the turntable 20 as shown in the Figures. After the part 42 is placed on the turntable 20, the robot 12 may drive the turntable 20 as described above, thereby rotating the part 42 and reorienting it relative to the robot 12. In this way, the robotic turntable drive 10 allows the robot 12 to easily access and reach all of the edges of the part 42 so that the robot 12 can hem these edges. In FIGS. 1 through 6, rotation of the turntable 20 by 90 degrees is shown. It should be understood, however, that the turntable 20 may be rotated any desired number of degrees.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A robotic turntable drive arrangement in a robotic roller hemming system comprising:

a turntable having a top plate and a lower frame, said top plate being rotatable about said lower frame;

said turntable further including a plurality of lock positions; and a robot having an arm adapted for engagement with said turntable top plate;

wherein movement of said robot arm while said robot arm is engaged with said turntable top plate rotates said turntable top plate.

2. The robotic turntable drive arrangement of claim 1, further including a locking device for locking said turntable at one of said lock positions.

3. The robotic turntable drive arrangement of claim 1, wherein said turntable top plate includes a plurality of engagement members spacedly disposed along an outer edge of said top plate that allow for engagement of said robot arm with said top plate.

4. The robotic turntable drive arrangement of claim 1, wherein said robot includes a roller end effector engagable with said turntable top plate.

5. A robotic turntable drive arrangement in a robotic roller hemming system comprising:

a robot including a base and a swingable, movable arm; said robot having a first axis of rotation extending through said base;

a turntable including a lower frame, a top plate, and a rotatable bearing connecting said lower frame to said top plate; said top plate being rotatable on said frame via said bearing;

said rotatable bearing including a round gear having a multiplicity of teeth defining lock positions around said round gear;

said robot arm being engagable with said turntable top plate; and a locking device for locking said turntable at one of said lock positions;

wherein said turntable top plate is rotatable by said robot arm via said bearing when said locking device is unlocked, whereby locking said locking device temporarily fixes said turntable at one of said lock positions.

6. The robotic turntable drive arrangement of claim 5, wherein said turntable top plate includes a plurality of engagement members spacedly disposed along an outer edge of said top plate that allow for engagement of said robot arm with said top plate.

7. The robotic turntable drive arrangement of claim 5, wherein the locking device is engagable with said teeth of the round gear for locking said turntable top plate at each of said lock positions.

8. The robotic turntable drive arrangement of claim 5, wherein said locking device is a lock clamp.

9. A method of driving a turntable in a robotic roller hemming system comprising the steps of:

providing a robotic turntable drive including:

a robot including a base and a swingable, movable arm; said robot having a first axis of rotation extending through said base;

a turntable including a lower frame, a top plate, and a rotatable bearing connecting said lower frame to said top plate; said top plate being rotatable on said frame via said bearing;

said rotatable bearing including a round gear having a multiplicity of teeth defining lock positions around said round gear; and a locking device for locking said turntable at one of said lock positions;

engaging said robot arm with said turntable top plate; and rotating said turntable top plate by said robot arm via said bearing when said locking device is unlocked, whereby locking said locking device temporarily fixes said turntable at one of said lock positions.

10. The method of claim 9, further comprising the steps of:

rotating said robot arm about said robot first axis to align said robot arm with a portion of said turntable;

engaging said robot arm with said turntable top plate;

unlocking said locking device;

rotating said turntable top plate from one lock position to another of said lock positions by moving said engaged robot arm;

locking said locking device; and releasing said robot arm from said turntable top plate.

11. The method of claim 10, wherein the step of providing a robotic turntable drive includes providing a turntable top plate including a plurality of engagement members spacedly disposed along an outer edge of said top plate; and the step of engaging the robot arm with the turntable top plate includes engaging the robot arm with one of the engagement members of the top plate.

* * * * *